US005863223A

United States Patent [19]

Arnold

[11] Patent Number: 5,863,223

[45] Date of Patent: Jan. 26, 1999

[54] PLUG ARRANGEMENT FOR A PLURALITY OF INDIVIDUAL PLUGS

[75] Inventor: Werner Arnold, Jüchen, Germany

[73] Assignee: Kendall-Medizinsche Erzeugnisse—Gessellschaft mit beschraenkter Hauftung, Neustadt/Donau, Germany

[21] Appl. No.: 747,566

[22] Filed: Nov. 12, 1996

[30] Foreign Application Priority Data

Nov. 10, 1995 [DE] Germany ..... 195 41 935.9

[51] Int. Cl.[6] ..... H01R 13/502

[52] U.S. Cl. ..... 439/701; 439/717; 439/733.1

[58] Field of Search ..... 439/695, 701, 439/733.1, 746, 717, 448

[56] References Cited

U.S. PATENT DOCUMENTS

| | | | |
|---|---|---|---|
| 3,772,635 | 11/1973 | Frey et al. | 439/488 |
| 4,820,169 | 4/1989 | Weber et al. | 439/717 |
| 4,913,667 | 4/1990 | Muz | 439/695 |
| 5,114,363 | 5/1992 | Mitra | 439/488 |
| 5,288,251 | 2/1994 | Sumida | 439/717 |
| 5,427,549 | 6/1995 | Smith et al. | 439/701 |

FOREIGN PATENT DOCUMENTS

| | | | |
|---|---|---|---|
| 1392634 | 2/1965 | France | 439/717 |
| 3012174C2 | 10/1981 | Germany | H01R 13/46 |
| 3807645A1 | 9/1989 | Germany | H01R 13/46 |

*Primary Examiner*—Paula Bradley
*Assistant Examiner*—Katrina Davis
*Attorney, Agent, or Firm*—Whitham, Curtis & Whitham

[57] ABSTRACT

A plug arrangement for a plurality of individual plugs with individual housings and each having at least one contact pin, with the individual plugs being connectable in a holder into a uniformly manipulatable plug, wherein the individual housing of each individual plug is surrounded by a cylindrical sleeve, rectangular in cross section, which is open at one end for insertion and has in an end wall on the opposite side, an opening to allow at least one contact of individual plug to pass through. The plug arrangement is especially usable for medical equipment in conjunction with body electrodes. Adaptation to different plug bushings from different equipment manufacturers is made possible by using sleeves with different wall thicknesses. In addition, a required colored marking of the individual plugs can be provided by using sleeves of different colors, so that individual plugs can all be made the same color.

13 Claims, 5 Drawing Sheets

PLUG ARRANGEMENT FOR A PLURALITY OF INDIVIDUAL PLUGS

BACKGROUND OF THE INVENTION

1. Field of the Invention

The present invention generally relates to a plug arrangement for a plurality of individual plugs with individual housings, each having at least one contact pin, with the individual plugs being connectable in a holder to form a uniformly manipulatable plug. More particularly, plug arrangements are provided for the connection of body electrodes to medical diagnostic and treatment equipment.

2. Background Description

Plug arrangements for a plurality of individual plugs with individual housings are known, for example, from DE 30 12 174 C2 and DE 38 07 645 A1. The individual plugs, which have essentially rectangular individual housings, are inserted or pushed into holders that are open on both sides in the lengthwise direction. By virtue of a positive connection between the holder and the correspondingly designed individual housings of the individual plugs, the individual plugs are locked in the holder in the lengthwise direction. In the embodiment disclosed in DE 38 07 645 A1, the individual plugs have grooves that are flush with one another, into which a foldable rib of the otherwise one piece holder engages to insure axial locking.

In the embodiment according to DE 30 12 174 C2, the holder is provided with specially shaped chambers, to whose shape the outside contour of the individual housings of the individual plugs is adapted. The holder has a foldable lid. When the lid is open, the individual plugs can be inserted from above into the chambers of the holder.

With the known plug arrangements, it is possible to connect the individual plugs to form a uniformly manipulatable plug arrangement, which can be inserted into a uniform matching piece. According to DE 38 07 645 A1, the holder has a tab pointing in the insertion direction, said tab cooperating with a matching recess in the matching piece to produce protection against twisting. The locking of the plug arrangement in the matching piece is accomplished by locking grooves which are formed on the contact pins of the plug arrangement and cooperate with matching locking elements in the matching piece.

While the type and dimensions of the contact pins of individual plugs have been standardized for many applications, there is no such uniformity for the dimensions of the individual housings of the individual plugs, 50 that the matching parts (generally device plugs) into which the plug arrangement is intended to be inserted, have different distances between the contact sets of the individual plugs, since the matching pieces are provided for differently dimensioned individual housings.

This means that different cable sets must be used with the individual plugs for the various matching pieces, for example, for different device plugs from different medical equipment manufacturers. If the cable sets are on body electrodes, this results in a considerable stocking cost for using body electrodes with medical equipment from different manufacturers. In practice, this problem arises for AAMI plugs which have been standardized as far as the contact arrangements of the individual plugs are concerned, for which plugs the various equipment manufacturers have provided contact spacings of different sizes in the bushings that form the matching pieces.

For using the plug arrangements mentioned hereinabove in conjunction with body electrodes, provision is also made such that the individual plugs, corresponding to the placement of the corresponding body electrodes on the body, have certain, different colors. Consequently, the individual plug housings must be made from materials with different colors, which naturally increases the manufacturing cost.

SUMMARY OF THE INVENTION

It is therefore an object of the present invention to provide reduction in the cost of manufacturing and/or stocking the plug arrangements of the types involving a plug arrangement for a plurality of individual plugs with individual housings, each having at least one contact pin, with the individual plugs being connectable in a holder to form a uniformly manipulatable plug.

The present invention departs from the problems of prior plug arrangements of the types described in the Background Description herein by providing an individual housing of each individual plug that is surrounded by a cylindrical sleeve that is rectangular in cross section, said sleeve being open at one end for insertion and having in an end wall on the opposite side, an opening through which at least one contact pin of the individual pin can pass. Preferably the sleeve is lockable on the individual housing of a matching individual plug, for example, when a recess is provided in one jacket side into which a locking projection on the individual plug can be snapped.

Since, according to the invention, each individual housing has a sleeve, the above-mentioned disadvantages of known plug arrangements can be significantly reduced.

If, according to one advantageous embodiment, sleeves of different wall thicknesses can be slid onto the individual plugs, it is possible with individual plugs that are always identical and which may be connected with body electrodes, merely by using a suitable sleeve, to effect an adaptation to different matching pieces from different manufacturers.

When the sleeves of the plug arrangement are made of differently colored material, it is no longer necessary for the individual plug housings to be of different colors.

The comparatively costly manufacture of individual plugs can therefore be carried out in the same way for all individual plugs since the colored identification that may be required is provided by the mounted sleeves.

Preferably the sleeves are lockable on the individual housings of the individual plugs. In addition, the sleeves can advantageously have a recess in one jacket surface into which a locking projection of the individual plug can be snapped. The locking projection is preferably made in the form of a barb, in order to insure a secure connection.

The recess can be formed by a window which a locking means of the holder can also engage from the outside. Preferably the wall of the sleeve is sloped in the vicinity of the window in such fashion that the window area on the outside is larger than the window area on the inside that serves for the locking connection to the individual plug.

The individual housings of the individual plugs and the internal contours of the sleeves adapted to them can, for example, have any shape, in other words, for example, round or oval in cross section, or polygonal, but a design of the individual plugs and the inside contour of the sleeves that is rectangular in cross section is preferred.

The plug arrangement according to the invention is preferably used for individual plugs with two contact pins and individual housings with a rectangular cross section with large and small jacket sides. The recess in the sleeve is then preferably located on a small jacket side. In this case it is advantageous to make the individual plug insertable into a holder, with the large jacket sides resting against one another.

It is clearly evident that the individual plugs within the scope of the invention need not necessarily be provided with pin contacts, but also can have bushing contacts that cooperate with pin contacts in the matching piece.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1A:
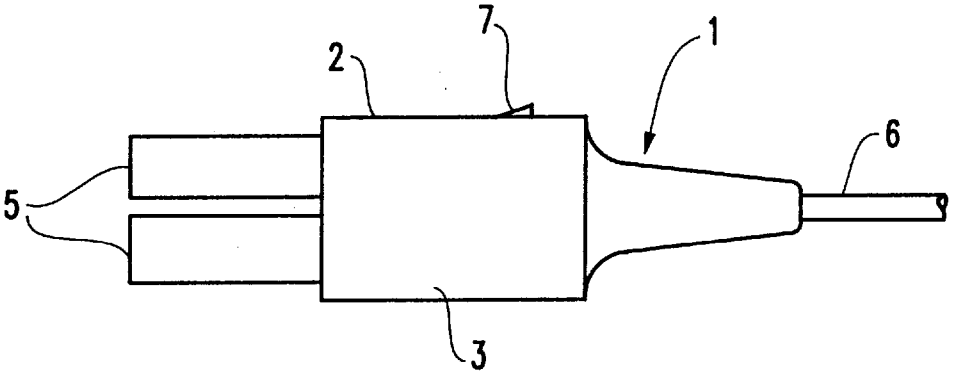
FIG. 1 shows three views 1*a*), 1*b*), and 1*c*) of an individual plug with two contact pins.

Referring now to the drawings, and more particularly to FIG. 1, there is shown an individual plug 1 with a rectangular housing 2 with large jacket surfaces 3 and small jacket surfaces 4 and two contact pins 5. Individual housing 2 is at the end of a cable 6 to which individual plug 1 is connected.

Figure 1B:
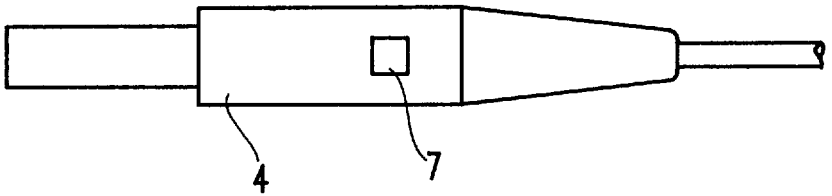

FIG. 1*a* shows a view of the individual plug on large jacket surface 3, and FIG. 1*b* shows a view of a small jacket surface 4.

On small jacket surface 4 is a locking projection 7 which has a sawtooth-shaped contour in the form of a barb.

Figure 1C:
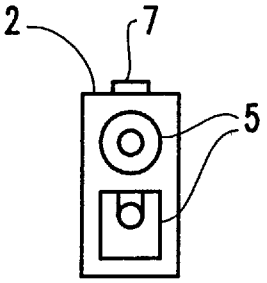

FIG. 1*c* is a view of the free end face of individual plug 1 and shows the shape of the two contact pins 5, one of which, according to AAMI standards, has a round cross section while the other has a square cross section.

FIG. 2 shows a plurality of views of a sleeve 8, which has a rectangular cross section and is open at one end face 9. At the opposite end face 10 the sleeve has through openings 11, whose shape matches the shape of contact pins 5. Sleeve 8, likewise, consists of large jacket surfaces 12 and small jacket surfaces 13, while FIG. 2*a* shows a view of a large jacket surface and FIG. 2*b* shows a view of a small jacket surface. The small jacket surface 13, toward which the view in FIG. 2*b* is directed, has a window-like through opening 14 whose size matches the size of locking projection 7 of individual housing 2. Through opening 14 is sloped toward the outside and forms an outer window surface 15 that is larger than the inwardly directed window surface formed by through opening 14.

Figure 2D:
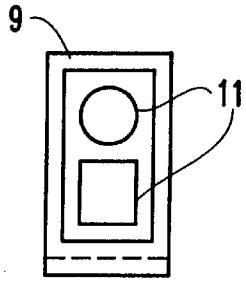
FIG. 2 shows four views 2*a*), 2*b*), 2*c*), and 2*d*) of a sleeve for the individual plug according to FIG. 1.
Figure 2A:
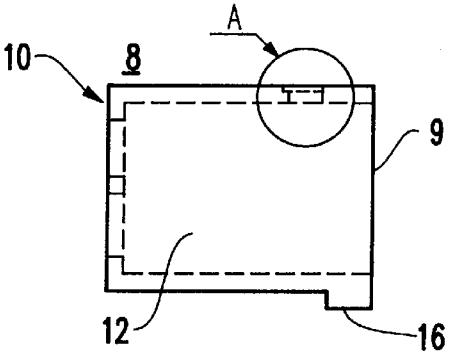
Figure 2B:
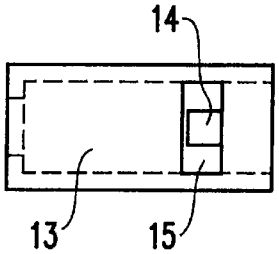
Figure 2C:
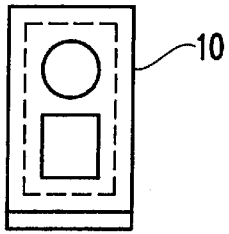

FIG. 2*a* and the views in FIG. 2*c* of end face 10 and in FIG. 2*d* of end 9 show that sleeve 8, on a small jacket surface 13 that is not provided with through opening 14, has a projection 16 formed by a step toward end 9.

Figure 3:
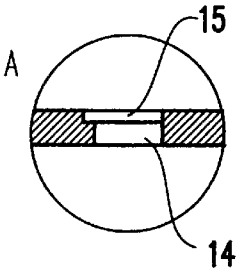
FIG. 3 shows an enlarged detail A of FIG. 2.

FIG. 3 shows in an enlarged and cut-away view that through opening 14 is sloped toward the outside and has a window area that is larger on the outside.

Figure 4A:
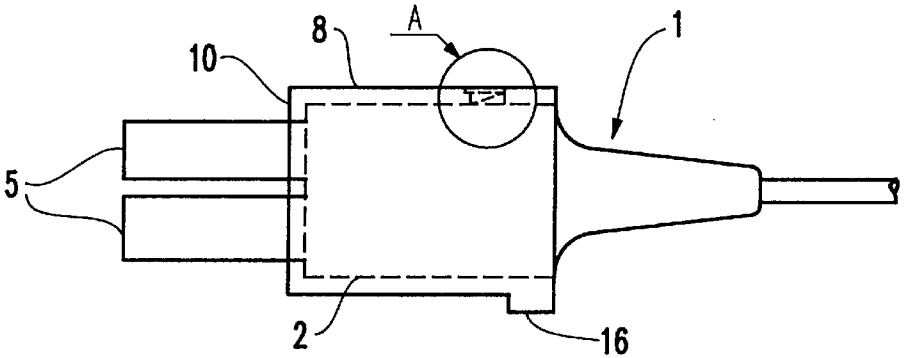
FIG. 4 shows three views 4*a*), 4*b*), and 4*c*) of the individual plug according to FIG. 1 with a locked sleeve according to FIG. 2.
Figure 4B:
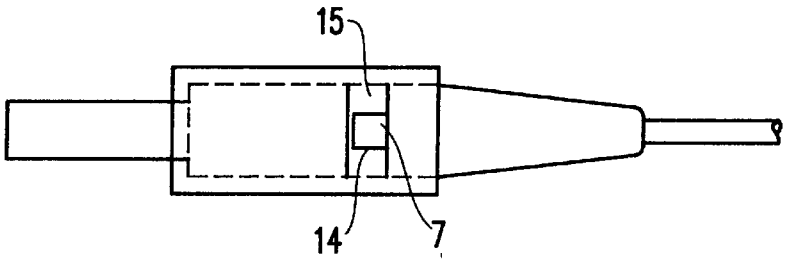
Figure 4C:
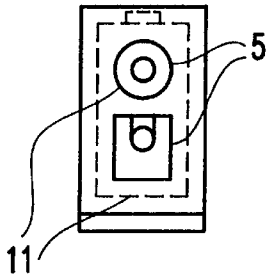

FIG. 4 shows three views of individual plug 1 with sleeve 8 snapped on. The position of contact pin 5 defines an insertion direction pointing toward the free end of contact 5 and shows that projection 16 of sleeve 8 is located at the rear in the insertion direction.

Figure 5:
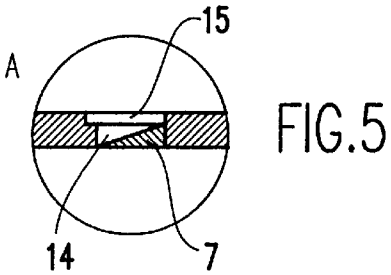
FIG. 5 is an enlarged detail A in FIG. 4.

In particular, the enlarged detail shown in FIG. 5 shows that locking projection 7 of plug housing 2 extends only up to the step in through opening 14, in other words it does not project through into the area of enlarged window area 15. Locking projection 7 prevents inadvertent extraction of individual plug 1 from sleeve 8. Further insertion of individual plug 1 in sleeve 8 is prevented by end face wall 10 provided with through openings 11 but is, otherwise, closed.

Figure 6:
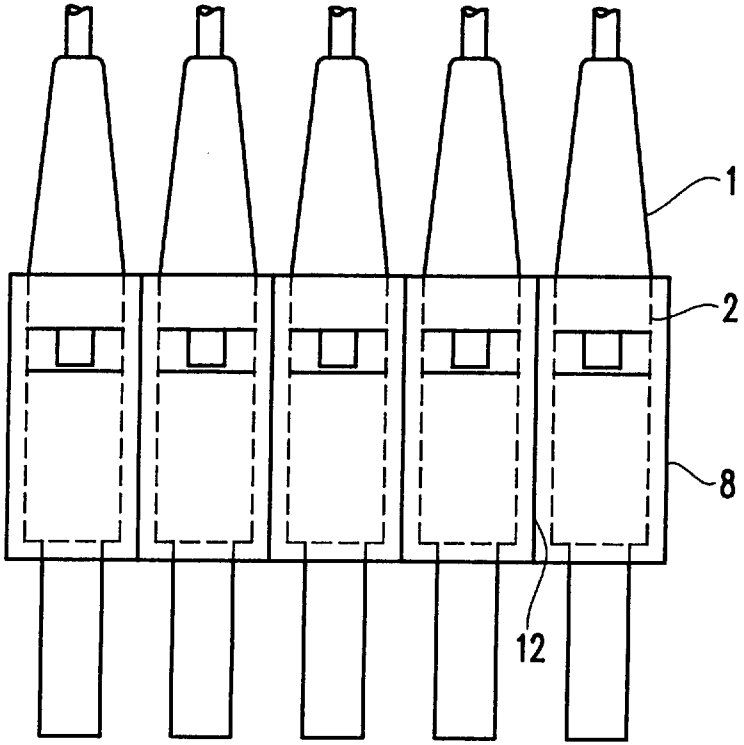
FIG. 6 is an arrangement of five individual plugs positioned side by side.

FIG. 6 makes clear that in the embodiment shown, five individual plugs 1 with individual plug housings 2 can be assembled into a compact block, in which the individual plug housings 2 with locked sleeves 8 abut one another by the large jacket surfaces 12 and are assembled flush with one another.

In the embodiment shown in FIG. 6, individual plug 1 can be received by the holder 17 shown in FIG. 7 and thus become a uniformly manipulatable plug arrangement.

Holder 17 consists of a bottom 18, two side walls 19, and a lid rib 20 articulated foldably on one side wall 19, said lid rib 20 being lockable by a locking nose 21 in a recess 22 in the other side wall 19 when the lid 20 is in the closed position. The holder 17 is open at both end walls 23 and 24.

The articulation of lid 20 on side wall 19 is made possible by a toothed design of the two parts and the insertion of a hinge pin 25.

Figure 7B:
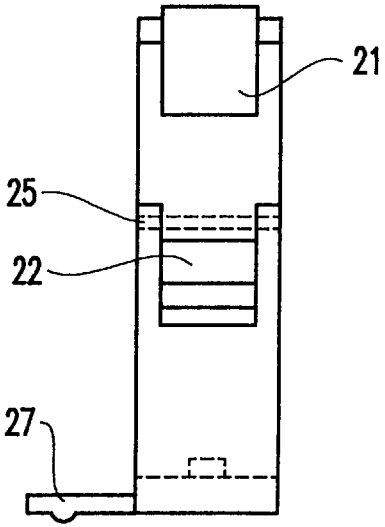
FIG. 7 shows four views 7*a*), 7*b*), 7*c*) and 7*d*) of a holder to the individual plugs in the arrangement according to FIG. 6.
Figure 7A:
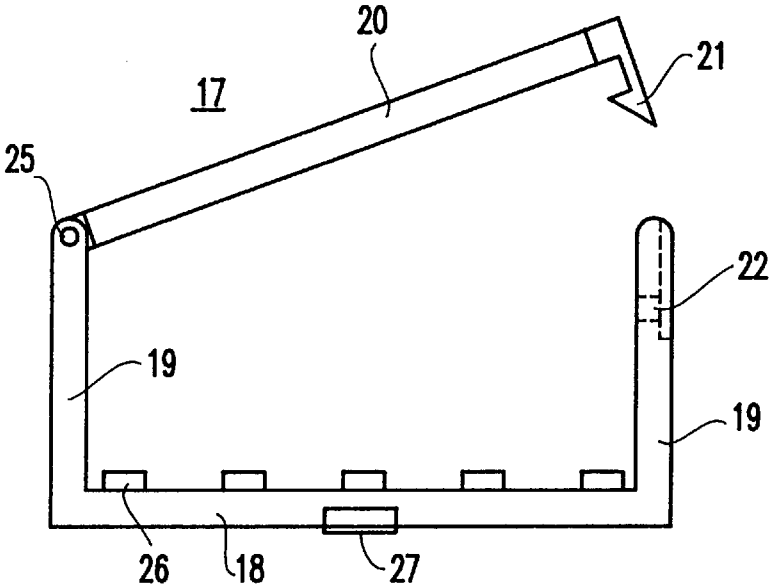
Figure 7D:
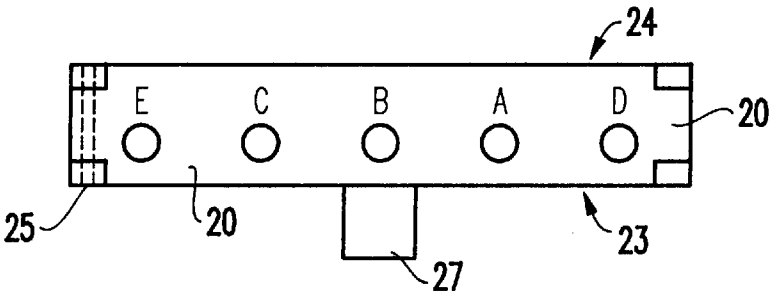
Figure 7C:
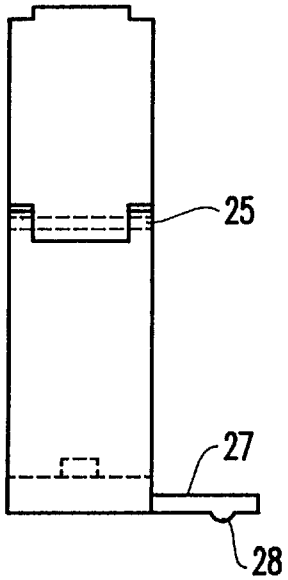

FIG. 7*a* shows a top view of the open end wall 23 with lid 20 in a partially opened position, FIG. 7*b* is a top view of side wall 19 provided with recess 22, and FIG. 7*c* is a top view of side wall 19 provided with hinge pin 25.

FIG. 7*d* is a top view of lid 20 which in the embodiment has markings in the form of letters and/or color identification for the transmission channels formed by individual plugs 1.

The axial immobilization of individual plugs 1 in holders 17 is performed by elevations 26 on bottom 18, whose size and position are selected so that they engage the large window opening 15 of through opening 14 in sleeve 8. Since the height of side walls 19 is adjusted to the height of the large jacket surface 12 of sleeve 8, sleeve 8 is thus held in place after lid 20 is closed.

On bottom 18, further in the forward insertion direction, in other words in front of end wall 23, a tab 27 is centrally mounted and projects, said tab having a locking bead 28 pointing downward. Tab 27 serves both for nonrotatable positioning of the plug arrangement and also for axial engagement of holder 17 and thus of all individual plugs 1 in holder 17, in the correspondingly designed (not shown) matching piece into which the plug arrangement is plugged.

The axial immobilization of the individual plugs in the matching piece is thus not effected by individual plugs 1 or their contact pins 5, but by the tabs 27 mounted on holder While the invention has been described in terms of a single preferred embodiment, those skilled in the art will recognize that the invention can be practiced with modification within the spirit and scope of the appended claims.

What is claimed is:

1. A plug arrangement, comprising:

a plurality of individual plugs with individual housings, each plug having at least one contact pin, whereby said individual plugs are connectable in a holder to form a uniformly manipulatable plug, wherein said individual housing of each said individual plug is surrounded by a cylindrical sleeve with said sleeve being formed to surround only a single plug, said sleeve having an external contour that is rectangular in cross section, said sleeve being open at one end for insertion of said contact pin and having in an end wall on an opposite end an opening to allow at least one contact pin of said individual plug to pass through.

2. A plug arrangement according to claim 1 wherein said sleeve is lockable on said individual housing of said individual plug.

3. A plug arrangement according to claim 1 wherein walls of said sleeves surrounding said individual plugs have different thicknesses.

4. A plug arrangement according to claim 1 wherein each said individual plug has two contact pins and said rectangular external contour of said sleeve is comprised of large and small jacket sides.

5. A plug arrangement according to claim 4 wherein said individual plugs are inserted into said holder with a large side of each of said surroundings sleeve jackets abutting one another.

6. A plug arrangement according to claim 1 wherein said sleeves of said plug arrangement are made of material of different colors.

7. A plug arrangement according to claim 6 wherein said individual plugs of said plug arrangement are made the same color.

8. A plug arrangement according to claim 4 wherein said plurality of individual plugs are assembled into a compact block wherein said plugs are arranged adjacent to and abutting one another at said large jacket sides of said sleeves.

9. A plug arrangement, comprising:

a plurality of individual plugs with individual housings, each plug having at least one contact pin, whereby said individual plugs are connectable in a holder to form a uniformly manipulatable plug, wherein said individual housing of each said individual plug is surrounded by a cylindrical sleeve comprised of jackets having an external contour that is rectangular in cross section, and said sleeve being open at one end for insertion of said contact pin and having in an end wall on an opposite end an opening to allow at least one contact pin of said individual plug to pass through, and wherein said sleeve has a recess in a side of one of said jackets into which a locking projection of said individual plug can be snapped.

10. A plug arrangement according to claim 9 wherein said locking projection is made in the shape of a barb.

11. A plug arrangement according to claim 9 wherein a recess is formed by a window in which a locking means of said holder can engage from outside.

12. A plug arrangement according to claim 11 wherein a wall in the vicinity of said window is sloped so that an area of said window is larger on the outside than that on the inside.

13. A plug arrangement according to claim 9, wherein said sleeve has a first recess located on a small jacket side of said sleeve.

* * * * *